US007287575B2

(12) United States Patent
Andersson et al.

(10) Patent No.: US 7,287,575 B2
(45) Date of Patent: Oct. 30, 2007

(54) COMPONENT FOR SUPPORTING A FILTER MEMBER, A DEVICE INCLUDING A TUBULAR FILTER MEMBER AND SAID COMPONENT, A PLATE HEAT EXCHANGER INCLUDING A TUBULAR FILTER MEMBER AND SAID COMPONENT

(75) Inventors: Göran Andersson, Lund (SE); Lars Rönnberg, Lund (SE)

(73) Assignee: Alfa Laval Corporate AB, Lund (SE)

( * ) Notice: Subject to any disclaimer, the term of this patent is extended or adjusted under 35 U.S.C. 154(b) by 712 days.

(21) Appl. No.: 10/433,997

(22) PCT Filed: Dec. 21, 2001

(86) PCT No.: PCT/SE01/02882

§ 371 (c)(1),
(2), (4) Date: Jun. 10, 2003

(87) PCT Pub. No.: WO02/052215

PCT Pub. Date: Jul. 4, 2002

(65) Prior Publication Data

US 2004/0069450 A1 Apr. 15, 2004

(30) Foreign Application Priority Data

Dec. 22, 2000 (SE) ..... 0004823

(51) Int. Cl.
*F28F 3/00* (2006.01)

(52) U.S. Cl. ..... 165/72; 165/80.1; 165/119; 165/166; 165/168; 165/178; 165/907; 210/175; 210/251

(58) Field of Classification Search ..... 210/175, 210/251
See application file for complete search history.

(56) References Cited

U.S. PATENT DOCUMENTS

| | | | | | |
|---|---|---|---|---|---|
| 441,497 | A | * | 11/1890 | Leland | 165/119 |
| 1,554,924 | A | * | 9/1925 | Shapiro | 165/119 |
| 2,412,032 | A | * | 12/1946 | Bill, Jr. | 210/292 |
| 2,709,525 | A | * | 5/1955 | Kimbro et al. | 210/232 |
| 2,889,933 | A | * | 6/1959 | Brundage | 210/541 |

(Continued)

FOREIGN PATENT DOCUMENTS

GB 1207919 10/1970

(Continued)

*Primary Examiner*—Robert James Popovics
(74) *Attorney, Agent, or Firm*—Fish & Richardson P.C.

(57) ABSTRACT

The invention relates to a component (20) for supporting a tubular filter member (15) in a portable channel (2) in a plate heat exchanger (1). The invention also relates to a device including the component (20) and the filter member (15). Furthermore, the invention relates to a plate heat exchanger (1), which includes a package of heat transfer plates (3) provided between a first plate (5) and a second plate (6). The filter member (15) has an inner surface and an outer surface. The component (20) includes a first part (21), which is arranged to be introduceable into the filter member (15) to abutment against the inner surface of the filter member, and a second part (22), which is arranged to abut a surface area of one of said first and second plates (5, 6), which surface area extends around the porthole channel (2).

10 Claims, 5 Drawing Sheets

U.S. PATENT DOCUMENTS 2,914,179 A * 11/1959 Foust ..... 210/323.2
3,034,652 A * 5/1962 Hobson, Jr. ..... 210/232
3,279,608 A * 10/1966 Levendusky et al. ..... 210/232
3,503,516 A * 3/1970 Harms et al. ..... 210/323.2
3,642,141 A * 2/1972 Hobson, Jr. ..... 210/323.2
3,675,777 A * 7/1972 Heskett et al. ..... 210/232
3,690,373 A * 9/1972 Wright ..... 165/119
3,750,889 A * 8/1973 Acosta ..... 210/497.01
3,760,873 A * 9/1973 Wright ..... 165/166
3,850,813 A * 11/1974 Pall et al. ..... 210/232
3,946,804 A * 3/1976 Tkach et al. ..... 165/167
4,014,672 A * 3/1977 Jansson ..... 55/357
4,291,752 A * 9/1981 Bridgnell ..... 165/81
4,304,297 A * 12/1981 Margraf ..... 165/175
4,309,287 A * 1/1982 Roos et al. ..... 210/247
4,319,631 A * 3/1982 Margraf ..... 165/76
4,443,237 A * 4/1984 Ulvestad ..... 55/379
4,489,776 A * 12/1984 Baron ..... 165/95
4,517,088 A * 5/1985 Miller ..... 210/411
4,522,717 A * 6/1985 Brust ..... 210/238
4,579,659 A * 4/1986 Eades et al. ..... 210/541
4,590,994 A * 5/1986 Champion ..... 165/119
4,690,208 A * 9/1987 Deck ..... 165/119
4,713,174 A * 12/1987 Zievers et al. ..... 210/233
4,849,104 A * 7/1989 Garcera et al. ..... 210/323.2
4,960,448 A * 10/1990 Zievers ..... 55/523
5,167,814 A * 12/1992 Pulek ..... 210/232
5,202,021 A * 4/1993 Griffin et al. ..... 210/232
5,211,846 A * 5/1993 Kott et al. ..... 210/232
5,238,717 A * 8/1993 Boylan ..... 428/35.7
5,250,179 A * 10/1993 Spearman ..... 210/315
5,307,868 A * 5/1994 Barbaud ..... 165/119
5,308,485 A * 5/1994 Griffin et al. ..... 210/232
5,401,406 A * 3/1995 Johnson et al. ..... 210/323.2
5,509,467 A * 4/1996 Gibbs ..... 165/119
5,554,283 A * 9/1996 Brinda et al. ..... 210/321.8
5,555,929 A * 9/1996 Ishikawa ..... 165/76
5,806,586 A * 9/1998 Osthues et al. ..... 165/174
5,916,435 A * 6/1999 Spearman et al. ..... 210/132
5,950,715 A * 9/1999 Jonsson et al. ..... 165/103
5,964,909 A * 10/1999 Brunner ..... 55/377
6,085,832 A * 7/2000 Rehberg ..... 165/167
6,096,207 A * 8/2000 Hoffman et al. ..... 210/232
6,116,332 A 9/2000 Vännman et al.
6,119,766 A 9/2000 Blomgren
6,183,529 B1 * 2/2001 Musso et al. ..... 55/484
6,299,662 B1 * 10/2001 Poulsen ..... 55/498
6,435,271 B1 * 8/2002 Pavlin ..... 165/178
6,660,160 B1 * 12/2003 Ernryd ..... 210/283
6,726,735 B1 * 4/2004 Oussoren et al. ..... 55/377
6,730,218 B2 * 5/2004 Bozenmayer ..... 210/232
6,749,747 B1 * 6/2004 Olapinski et al. ..... 210/184
7,007,749 B2 * 3/2006 Brost et al. ..... 165/167
7,169,302 B2 * 1/2007 Stockbower ..... 210/232
2002/0000310 A1 * 1/2002 Cheadle ..... 165/167
2003/0019620 A1 * 1/2003 Pineo et al. ..... 165/297
2003/0106679 A1 * 6/2003 Brost et al. ..... 165/154
2003/0121649 A1 * 7/2003 Seiler et al. ..... 165/167
2004/0069450 A1 * 4/2004 Anderson et al. ..... 165/72
2004/0134637 A1 * 7/2004 Helin et al. ..... 165/11.1

FOREIGN PATENT DOCUMENTS

SE 506845 2/1998
SE 507800 7/1998

* cited by examiner

COMPONENT FOR SUPPORTING A FILTER MEMBER, A DEVICE INCLUDING A TUBULAR FILTER MEMBER AND SAID COMPONENT, A PLATE HEAT EXCHANGER INCLUDING A TUBULAR FILTER MEMBER AND SAID COMPONENT

CROSS REFERENCE TO RELATED APPLICATIONS

This application is a National Stage application under 35 U.S.C. §371 that claims the benefit of PCT/SE01/02882, filed Dec. 21, 2001, which claims the benefit of Sweden Application Ser. No. 0004823-1, filed Dec. 22, 2000. This application claims priority to International Application Ser. No. PCT/SE01/02882 and Sweden Application Ser. No. 0004823-1.

THE BACKGROUND OF THE INVENTION AND PRIOR ART

The present invention refers to a component for supporting a tubular filter member in a porthole channel of a plate heat exchanger, which includes a package of heat transfer plates provided between a first plate and a second plate, wherein the filter member has an inner surface and an outer surface. The invention also refers to a device including a tubular filter member and a component for supporting the filter member in a porthole channel of a plate heat exchanger, which includes a package of heat transfer plates provided between a first plate and a second plate, wherein the filter member has an inner surface and an outer surface. Furthermore, the invention refers to a plate heat exchanger including a package of heat transfer plates, which are provided between a first plate and a second plate, a tubular filter member, which has an inner surface and an outer surface and a component for supporting the filter member in a porthole channel of the plate heat exchanger.

It is known to use such tubular filter members in plate heat exchangers for different applications and fluids, for instance seawater containing algae, dirt, and other particles. The filter member, which may be formed by a substantially circular cylindrical perforated sheet pipe, is then introduced into the porthole channel of the plate package. Between the plates and the filter member, a gap arises for various reasons. In order to enable the mounting and replacement of the filter member, there has to be a gap between the plates and the filter member. The geometry of the portholes and the channel plates is such that a gap is formed. The tolerance of manufacture is limited.

One problem of such known filter members is the sealing of the gap between the filter member and the heat transfer plates. The fluid which is conveyed into the plate heat exchanger from the inlet pipe can partly penetrate the gap and from the gap continue into the plate interspaces. This liquid, which penetrates the gap from the inlet pipe, will thus not pass through the filter. Consequently, dirt and other particles, which might be present in the fluid, may be guided into the plate interspaces. Another problem is to obtain a stable positioning of the filter member at the same time as the latter has to be removable in an easy manner. If the filter manner lacks support and a determined position, the movements of the filter member can lead to damages on the filter member, the plates, and other components, for instance parts of rubber gaskets between the plates.

GB-A-1 207 919 discloses a plate heat exchanger including a package of heat transfer plates provided between a first end plate and a second end plate. A tubular filter member, which has an inner surface and an outer surface, is provided in a porthole channel of the plate heat exchanger. In order to position the filter member in the porthole channel, it is proposed to provide a number of rods provided with sleeves in the porthole channel between the plates and the filter member. In order to seal the gap between the filter member and the plates, it is proposed to provide a sealing ring, which is provided at the end of filter member and which is arranged to seal the inner wall of the inlet channel connected to the porthole channel in which the filter member is provided.

SUMMARY OF THE INVENTION

The object of the present invention is to enable a proper sealing of the gap between the filter member and the plates. Furthermore, it is aimed at a simple and secure positioning of the filter member in a porthole channel of a plate heat exchanger.

This object is achieved by the component initially defined, which is characterised in that it includes a first part, which is arranged to be introduceable into the tubular member to abutment against the inner surface of the filter member, and a second part, which is arranged to abut a surface area of one of said first and second plates, which surface area extends around the porthole channel.

Such a second part of the component may extend over the gap formed between the filter member and the heat transfer plates, and in such a way prevent the liquid from penetrating the gap without passing the filter member. Advantageously, the second part is arranged to sealingly abut said surface area of one of the first or second plate. These plates are preferably, but not necessarily, the end plates or the frame or pressure plate of the plate heat exchanger.

According to an embodiment of the invention, the first part is arranged to sealingly abut the inner surface of the filter member. In such a way, there is no possibility for the heat transfer fluid to penetrate the gap without passing the filter member. By means of this feature, the advantage is also obtained that the filter member is given a support and a fixed position in relation to the plate heat exchanger and the porthole channel. In this connection, the first part may be arranged to abut the inner surface of the filter member by means of a clearance fit. In such a way, an easy introduction of the component into the filter member is obtained. Preferably, the first part, as well as the filter member, is annular.

According to a further embodiment, the first part has an extension from the second part, wherein the first part along at least a part of said extension is tapering in a direction from the second part. By such a shape of the first part, the introduction of the component into the tubular filter member is facilitated.

According to a further embodiment of the invention, also the second part is annular. Advantageously, the second part is substantially plane. In such a way, said sealing abutment against the first or second plate may be obtained in an efficient and easy manner. In that connection, the second part may form a flange, which extends substantially radially outwardly from the first part.

According to a further embodiment of the invention, the first part and the second part form an integrated unit. The first part and the second part may be manufactured from a thin, substantially continuous, annular plate. Such a plate may be a metal sheet, which has been given the final shape of the component through plastic deformation. Also other materials than metals may be used for the component, for instance various types of plastic materials.

According to a further embodiment of the invention, means are arranged to define the position of the component in such a way that the first part is substantially concentric with regard to the porthole channel. Such means may for instance be obtained by means of attachment bolts of the first or the second plate. These attachment bolts, which may be intended to attach a pipe connected to the porthole channel of the plate heat exchanger, define the position of the second part on said surface area. Said means will thus position the filter member in the porthole channel in such a way that a gap is formed between the filter member and the plates. Preferably, this gap extends around the filter member and has advantageously a substantially uniform gap width.

The object is also achieved by the device initially defined, which is characterised in that a component includes a first part, which is arranged to be introduceable into the tubular filter member to abutment against the inner surface of the filter member, and a second part, which is arranged to abut a surface area of one of said first and second plates, which surface area extends around the porthole channel.

According to an embodiment of the invention, the filter member has a first end, through which the component is arranged to be introduceable, and a second end, which has an annular flange extending substantially radially outwardly from the filter member. Advantageously, the flange of the filter member is arranged to abut a surface area of one of said first and second plates, which surface area extends around the porthole channel. By such a flange, the gap between the filter member and the heat transfer plates may be sealed. Furthermore, the filter member may be maintained in a fixed position in relation to the porthole channel by means of such a flange. Advantageously, a component may then, according to the invention, be introduced into the first open end of the filter member. The flange of the filter member may, in the same way as the second part of the component, be arranged to sealingly abut said surface area and advantageously be substantially plane.

The object is also achieved by the plate heat exchanger initially defined, which is characterised in that the component includes a first part, which is arranged to be introduceable into the tubular filter member to abutment against the inner surface of the filter member, and a second part, which is arranged to abut a surface area of one of said first and second plates, which surface area extends around the porthole channel.

Advantageous embodiments of the plate heat exchanger are defined in the dependent claims.

BRIEF DESCRIPTION OF THE DRAWINGS

The present invention is now to be explained more closely by a description of various embodiments shown by way of example and with reference to the drawings attached.

DETAILED DESCRIPTION OF VARIOUS EMBODIMENTS OF THE INVENTION

Figure 1:
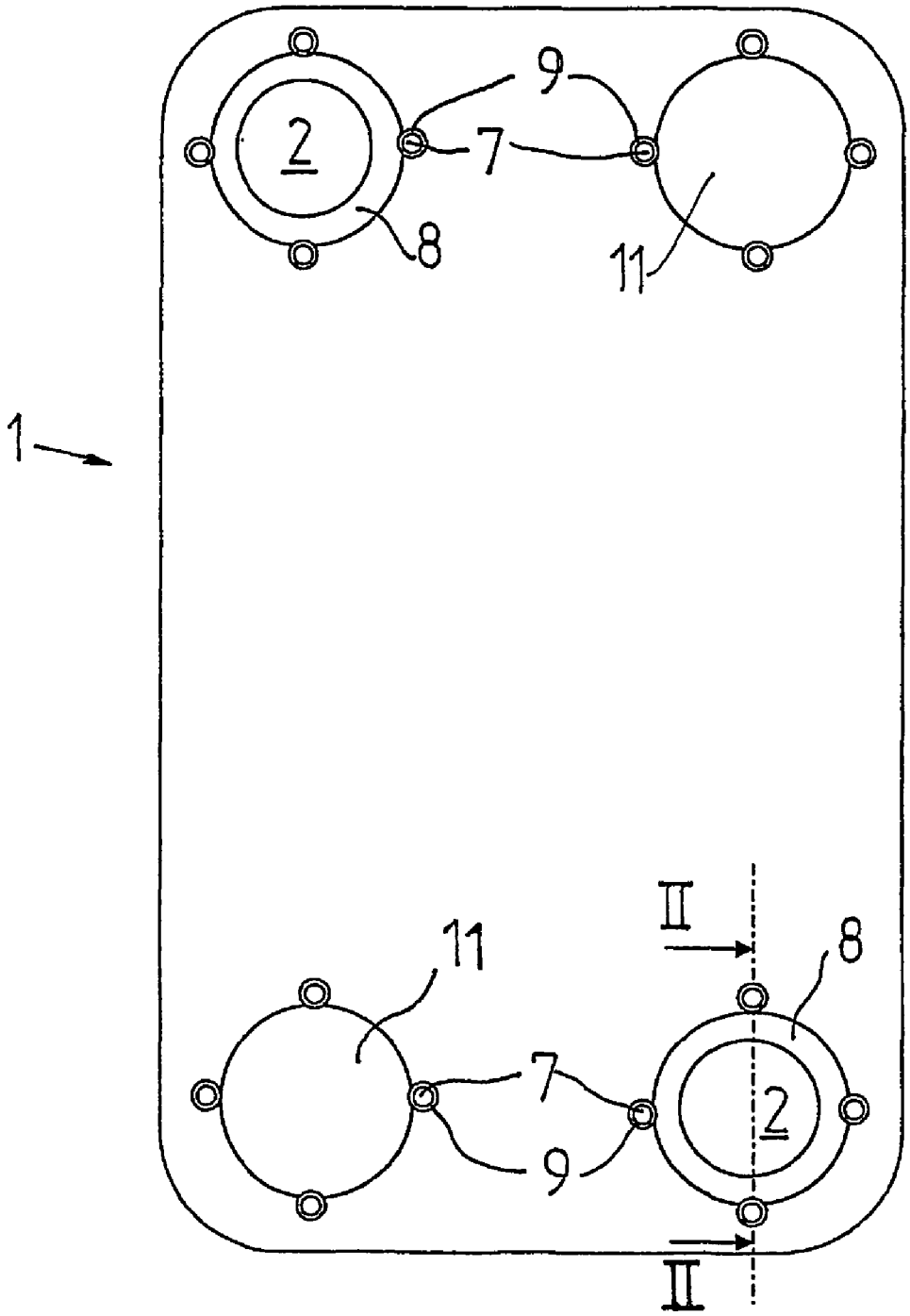
FIG. 1 discloses a plane view of a plate heat exchanger.
Figure 2:
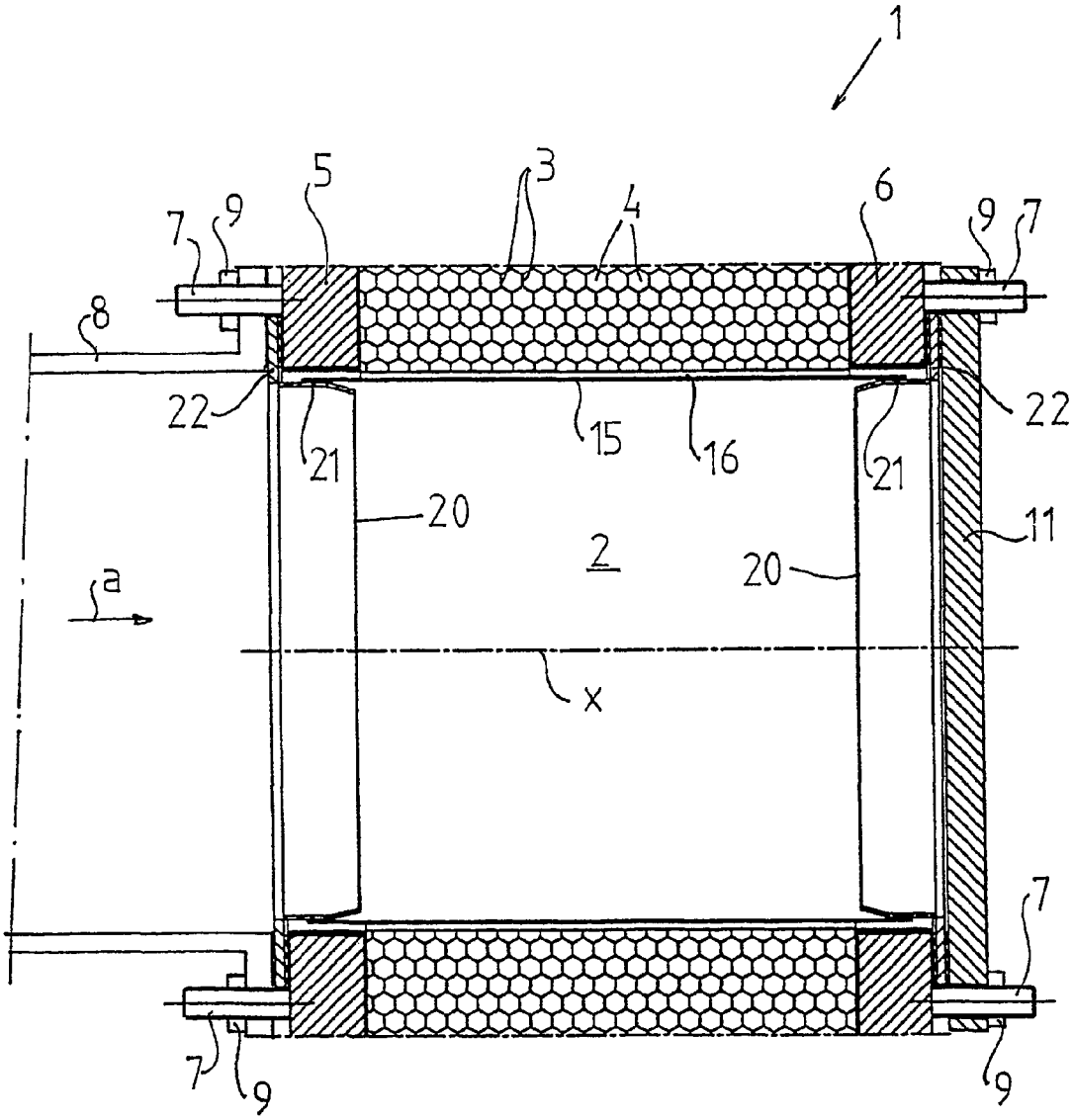
FIG. 2 discloses a sectional view along the line II-II in FIG. 1 with a component and a filter member according to the first embodiment of the invention.

FIG. 1 discloses a plane view of a plate heat exchanger 1 with four porthole channels 2. FIG. 2 discloses a section through the plate heat exchanger 1 and one of the porthole channels 2 along the line II-II in FIG. 1. Each porthole channel 2 extends through the plate heat exchanger 1 along a centre axis x of the porthole channel 2. As appears from FIG. 2, the plate heat exchanger includes a large number of heat transfer plates which lie adjacent to each other and form a plate package. The heat transfer plates are provided adjacent to each other and form plate interspaces 4 between adjacent heat transfer plates 3. These plate interspaces 4 form, in a manner known per se, at least two separate flow channels for a first medium and a second medium, respectively. The plate package may be kept together in manners known per se, for instance by brazing, welding, gluing, or by means of tightening bolts, wherein gaskets are provided between the heat transfer plates 3 in order to separate said channels.

The plate package has a first end plate 5 and a second end plate 6. In the embodiment disclosed in FIG. 2, the first end plate 5 is a so-called frame plate and the second end plate 6 is a so-called pressure plate. According to this embodiment, the plate package is kept together by pressing the frame plate and the pressure plate against each other by means of tightening bolts. In an embodiment, where the plate package is brazed, or permanently connected in any other way, the first end plate 5 and the second end plate 6 may be formed by outer heat transfer plates 3.

The first end plate 5 and the second end plate 6 both include attachment bolts 7, which extend outwardly from the plate package. The attachment bolts 7 of the first end plate 5 are in the embodiment disclosed arranged to enable mounting of a connection pipe 8 to the plate heat exchanger 1, wherein a mounting flange of the connection pipe 8 is clamped against the first end plate 5 by means of nuts 9. A heat transfer medium may thus flow in the direction of the arrow a through the connection pipe 8 into the porthole channel 2 and further into one of said flow channels. The attachment bolts 7 of the second end plate 6 are arranged to enable attachment of a stop plate 11, which is intended to close the porthole channel 2.

In the porthole channel 2, a tubular filter member 15 is provided. The filter member 15 is substantially cylindrical and has an outer surface and an inner surface. The filter member 15 extends around the inner surface of the porthole channel 2 in the proximity of the outer periphery of the porthole channel 2. However, the filter member 15 is provided at a small distance from the heat transfer plates 3 in such a way that an annular gap 16 is formed between the heat transfer plates 3, the first plate 5, and the second plate 6 on the one hand and the filter member 15 on the other hand. The filter member 15 has in the embodiment disclosed a substantially circular cross-section. The filter member 15 is manufactured from a sheet, preferably of stainless steel or any other corrosion resistant metal. The sheet is perforated with small holes permitting through-flowing of the heat transfer medium, but having such a size that dirt or other particles will be caught by the filter member 15. In order to enable cleaning of the filter member 15, it is thus essential that the latter may be removed from the porthole channel 2 of the plate heat exchanger 1 in an easy manner.

In the embodiment disclosed in FIG. 2, the filter member 15 is supported by a component 20 at each end of the filter member 15. Each of the components 20 are thus introduced into a respective end of the filter member 15. Each component 20 includes a first part 21, which is introduceable into the tubular filter member 15 in such a way that the first part 21 abuts the inner surface of the filter member 15. Furthermore, each component has a second part 22, which abuts an outer surface area of one of said end plates 5, 6. The second part 22 is substantially plane and extends substantially radially outwardly from the first part with regard to the centre axis x. It is to be noted that the centre axis x in the mounted state disclosed in FIG. 2, also forms, substantially, the centre axis for the component 20, the filter member 15 and the porthole channel 2. The second part 22 may thus sealingly abut the outer surface of one of the end plates 5, 6. In such a way, the second part 22 will extend over the gap between the filter member 15 and the heat transfer plates 3. Furthermore, it is possible to provide any form of a gasket between the second part 22 and the outer surface of the respective end plate 5, 6.

Figure 4:
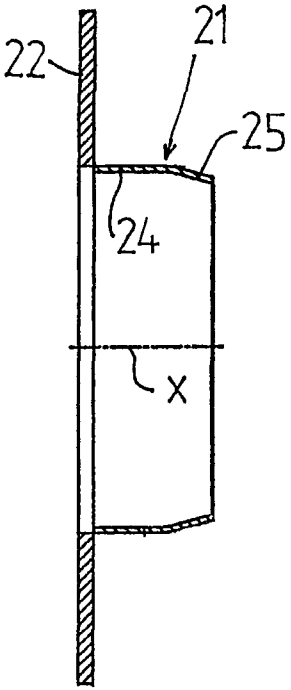
FIG. 4 discloses a sectional view of the component along the line IV-IV in FIG. 3.
Figure 3:
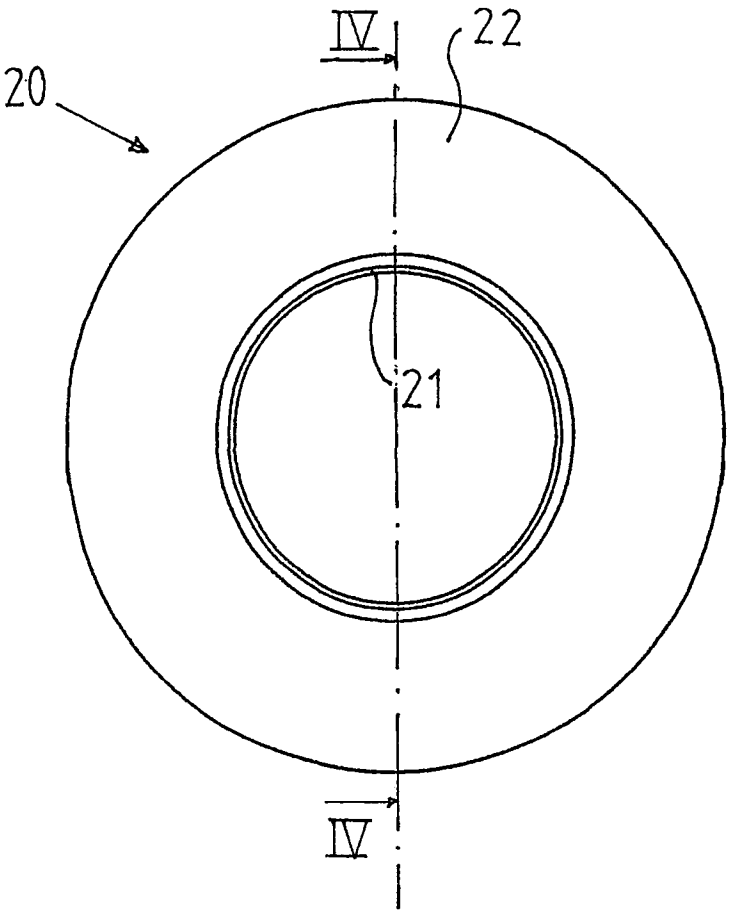
FIG. 3 discloses a plane view of the component in FIG. 2.

The shape of the component 20 is disclosed more closely in FIGS. 3 and 4. As appears from especially FIG. 4, the first part 21 has a first cylindrical portion 24, which extends concentrically with the centre axis x from the second part 22 and a tapering portion 25, which in the example disclosed extends substantially conically from the cylindrical portion 24. In such a way, the introduction of the first part 21 into the tubular filter member 15 is facilitated. The first part 21 is preferably dimensioned in such a way that the cylindrical portion 25 sealingly abuts the inner surface of the filter member 15. Advantageously, the component 20 is designed in such a manner that the cylindrical portion 24 engages the inner surface of the filter member 15 with a clearance fit. In such a way, an easy introduction and a secure support for the filter member 15 is obtained.

The first part 21 and the second part 22 form an integrated unit, which is manufactured in one single piece of material. Preferably, the component 20 may be manufactured of a metallic material, which is plastically deformed to the shape disclosed. Also other manufacturing methods are, of course, possible. The first part 21 may for instance be welded to the second part 22. Also other materials than metals may be used for the component 20, for instance different types of plastic material. In the embodiment disclosed, the first part has a material thickness of about 1,5 mm and the second part a material thickness of about 5 mm.

The concentric position of the first part 21 in the porthole channel 2 is determined by means of the attachment bolts 7. The second part 22 has a diameter, which corresponds to the diameter of the circle enclosed between the attachment bolts 7. In the embodiment disclosed, the first part 21 is thus concentric with regard to the periphery of the second part 22. The component 20 is kept in position by means of nuts 29 and the mounting flange of the connection pipe 8. The second part 22 is thus clamped between the mounting flange of the connection pipe 8 and the outer surface of the first end plate 5. The opposite component 20 in FIG. 2 is attached in a corresponding manner between the stop plate 11 and the outer surface of the other end plate 6. In such a way, the position of the components 20 in relation to the centre axis x is determined. Also the position of the filter member 15 in relation to the centre axis x is thus determined. However, the first part 21 does not need to be concentric with the periphery of the second part 22. If the attachment bolts 27 are positioned in another manner, the first part 21 may be eccentric in relation to the periphery of the second part 22. The position of the component 20 in relation to the porthole channel 2 may also be defined by other means than the attachment bolts 27 disclosed herein. For instance, steps may be attached to the outer surface of the end plate 5, 6. It is also possible to provide the end plate 5, 6 with a depression arranged to receive the second part 22 in a determined position.

Figure 5:
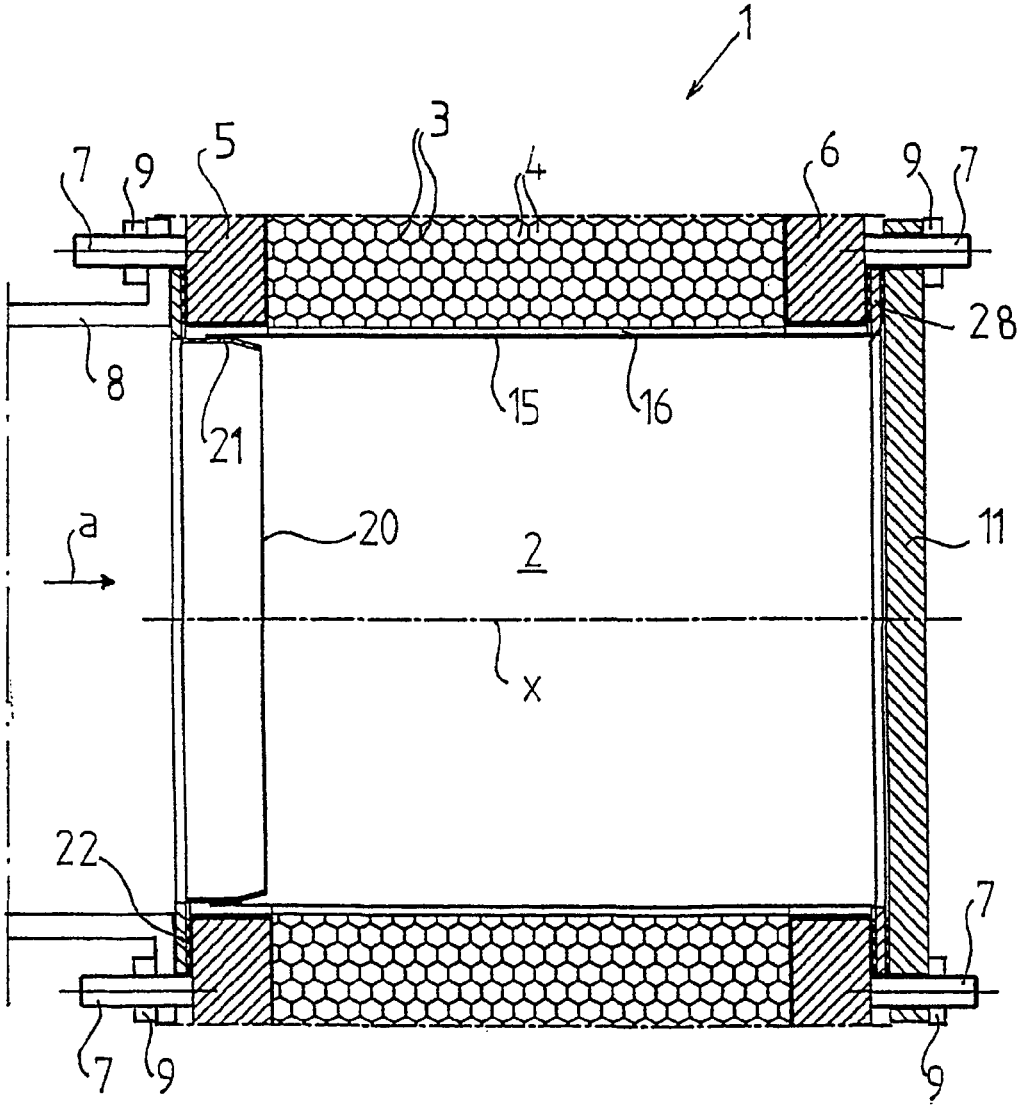
FIG. 5 discloses a view corresponding to the one in FIG. 2 with a filter member according to a second embodiment of the invention.
Figure 7:
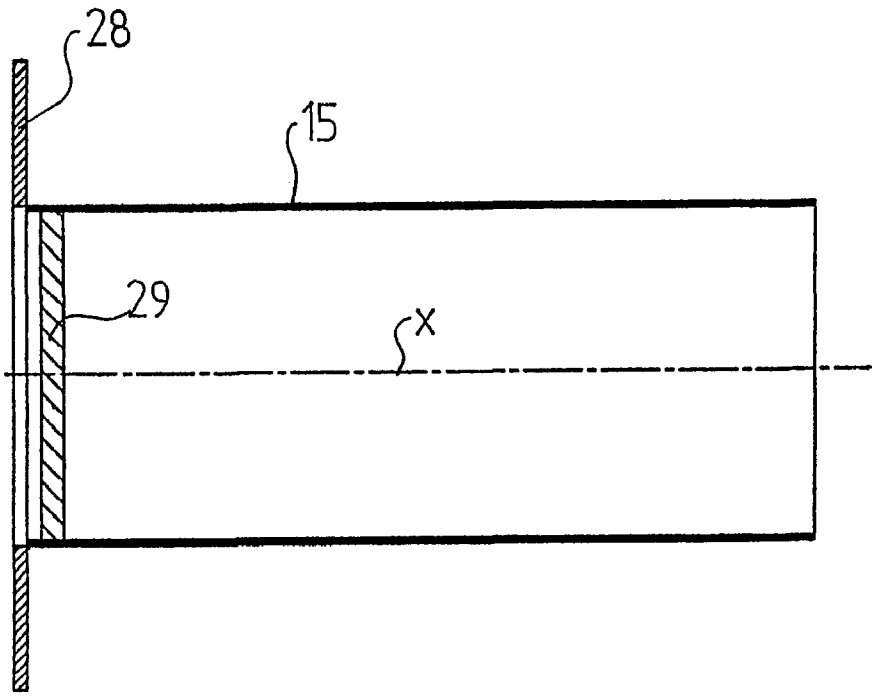
FIG. 7 discloses a sectional view of the filter member along the line VII-VII in FIG. 6.
Figure 6:
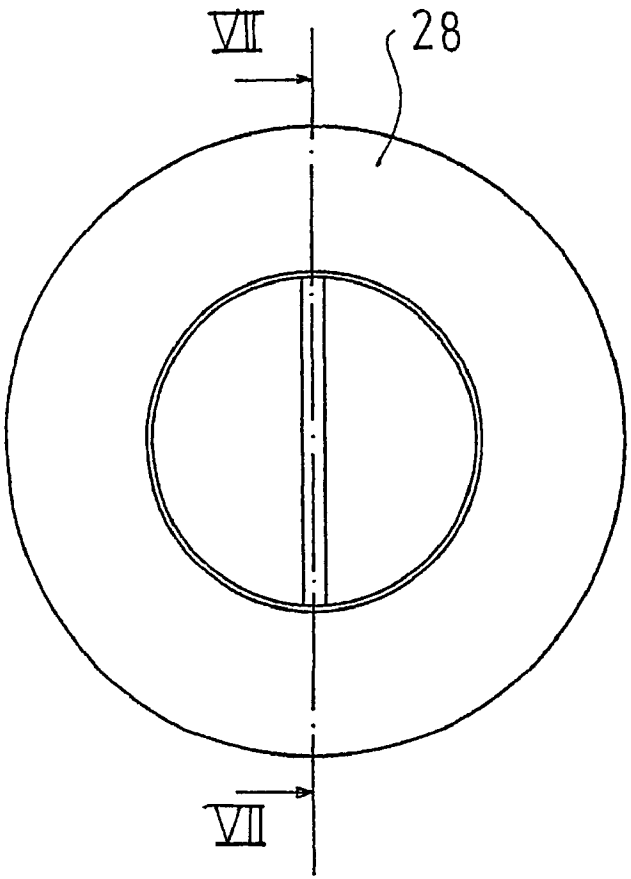
FIG. 6 discloses a plane view of the filter member in FIG. 5.

FIGS. 5, 6, and 7 disclose a second embodiment of the invention. In this embodiment, the filter member 15 has at the second end an annular flange 28, which extends substantially radially outwardly from the filter member 15. The flange 28 has a shape, which corresponds to the shape of the second part 22 of the component 20. The flange 28 is thus also substantially plane and arranged to abut the outer surface of the second end plate 6. The annular flange 28 is also intended to be positioned with regard to the centre axis x by means of the attachment bolts 7 and clamped between the outer surface of the second end plate 6 and the stop plate 11. In such a way, the filter member 15 may obtain a fixed and determined position in the porthole channel 2. As appears from FIGS. 6 and 7, the filter member 15 may at the second end also include a handle 29 by which the filter member 15 in a easy manner may be lifted out of the porthole channel 2 when the stop plate 11 has been removed.

The invention is not limited to the embodiments disclosed but may be varied and modified within the scope of the following claims.

What is claimed is:

1. In a porthole channel of a plate heat exchanger which includes a package of heat transfer plates provided between a first plate and a second plate, the improvement comprising a device having a tubular filter member and a component for supporting the filter member in the porthole channel, wherein the filter member has an inner surface, an outer surface, a first open end, through which the component is arranged to be introduceable, and a second end, which has an annular flange extending substantially radially outwardly from the filter member, the flange being arranged to abut the surface area of one of the first or second plates, and the component includes a first part, which is constructed and arranged to be introduceable into the tubular filter member and to abut against the inner surface of the filter member, and a second part, which is constructed and arranged to abut a surface area of one of the first and second plates, and wherein the surface area extends around the porthole channel.

2. A device according to claim 1, wherein the second part is arranged to sealingly abut the surface area.

3. A device according to claim 1, wherein the flange of the filter member is arranged to sealingly abut the surface area.

4. A device according to claim 1, wherein the flange of the filter member is substantially planar.

5. A plate heat exchanger comprising:

a package of heat transfer plates which is provided between a first plate and a second plate, a tubular filter member, which has an inner surface and an outer surface and a component for supporting the tubular filter member in a porthole channel of the plate heat exchanger, wherein the filter member has a first open end, through which the component is arranged to be introduceable, and a second end, which has an annular flange extending substantially radially outwardly from the filter member, and the flange is arranged to abut the surface area of one of the first or second plates, and the component includes a first part, which is constructed and arranged to be introduceable into the tubular filter member and to abut against the inner surface of the filter member, and a second part, which is constructed and arranged to abut a surface area of one of the first or second plates, which surface area extends around the porthole channel.

6. A plate heat exchanger according to claim 5, wherein the second part is arranged to sealingly abut the surface area.

7. A plate heat exchanger according to claim 5, further comprising means arranged to define the position of the component in such a way that the first part is substantially concentric with regard to the porthole channel.

8. A plate heat exchanger according to claim 7, wherein the means is arranged to position the filter member in the porthole channel in such a way that a gap is formed between the filter member and the plates.

9. A plate heat exchanger according to claim 5, wherein the flange of the filter member is arranged to sealingly abut the surface area.

10. A plate heat exchanger according to claim 5, wherein the flange of the filter member is substantially planar.

* * * * *